US008434560B2

(12) United States Patent
Baskett et al.

(10) Patent No.: US 8,434,560 B2
(45) Date of Patent: May 7, 2013

(54) TUBING HANGER WITH INTEGRAL ANNULUS SHUTOFF VALVE

(75) Inventors: David Baskett, Houston, TX (US); Scott Stjernstrom, Houston, TX (US)

(73) Assignee: Cameron International Corporation, Houston, TX (US)

( * ) Notice: Subject to any disclaimer, the term of this patent is extended or adjusted under 35 U.S.C. 154(b) by 348 days.

(21) Appl. No.: 12/598,407

(22) PCT Filed: Apr. 25, 2008

(86) PCT No.: PCT/US2008/061525

§ 371 (c)(1),
(2), (4) Date: Oct. 30, 2009

(87) PCT Pub. No.: WO2008/137340

PCT Pub. Date: Nov. 13, 2008

(65) Prior Publication Data

US 2010/0116488 A1 May 13, 2010

Related U.S. Application Data

(60) Provisional application No. 60/915,178, filed on May 1, 2007.

(51) Int. Cl.
*E21B 33/03* (2006.01)

(52) U.S. Cl.
USPC ..... 166/379; 166/75.14; 166/88.4; 166/87.1

(58) Field of Classification Search ..... 166/75.14, 166/95.1, 88.4, 87.1, 379, 377
See application file for complete search history.

(56) References Cited

U.S. PATENT DOCUMENTS

| | | | | |
|---|---|---|---|---|
| 4,903,774 | A * | 2/1990 | Dykes et al. | 166/363 |
| 5,168,933 | A * | 12/1992 | Pritchard et al. | 166/348 |
| 5,465,794 | A | 11/1995 | McConaughy et al. | |
| 5,687,794 | A | 11/1997 | Watkins et al. | |
| 5,706,893 | A * | 1/1998 | Morgan | 166/86.1 |
| 6,679,330 | B1 | 1/2004 | Compton et al. | |
| 6,918,452 | B2 | 7/2005 | Chan et al. | |
| 7,156,169 | B2 * | 1/2007 | Bartlett | 166/66.7 |
| 2002/0029887 | A1 * | 3/2002 | Baskett et al. | 166/368 |

FOREIGN PATENT DOCUMENTS

EP 0349685 A1 1/1990

OTHER PUBLICATIONS

International Search Report and Written Opinion for Application No. PCT/US2008/061525 dated Aug. 22, 2008 (10 p.).

* cited by examiner

*Primary Examiner* — David Andrews
(74) *Attorney, Agent, or Firm* — Chamberlain Hrdlicka

(57) ABSTRACT

Apparatus and method for isolating an annular bore below a tubing hanger body disposed in a wellhead assembly. The hanger body is characterized by at least two annulus flowby passages that are capable of fluid communication with areas outside the hanger body through the central bore of the hanger body. An integral valve piston is disposed within the central bore of the hanger body, and is operable to axially displace within the central bore between a closed and opened position. The displacement of the piston is caused by the alternating introduction of pressurizing fluid into separate actuation chambers. In the closed position, the piston is positioned so that at least one of the flowby passages is sealingly engaged in a manner that prevents fluid flow through the hanger body from outside sources such as an annulus bore located below the hanger body.

39 Claims, 9 Drawing Sheets

TUBING HANGER WITH INTEGRAL ANNULUS SHUTOFF VALVE

CROSS-REFERENCE TO RELATED APPLICATIONS

The present application claims priority to PCT/US2008/061525 filed Apr. 25, 2008, which is hereby incorporated herein by reference in its entirety for all purposes, and claims the benefit of priority to U.S. Provisional Application No. 60/915,178 filed on May 1, 2007.

STATEMENT REGARDING FEDERALLY SPONSORED RESEARCH OR DEVELOPMENT

Not applicable.

BACKGROUND

1. Field of the Invention

The invention relates generally to an annulus shutoff valve. More particularly, the present invention relates to an annulus shutoff valve that seals one or more annulus flowby ports. Still more particularly, the present invention relates to a subsea tubing hanger with an integral annulus shutoff valve, which seals one or more annulus flowby ports in the tubing hanger, and is employed to safely close off or isolate an annular space below the tubing hanger.

2. Background of the Invention

In general, valves are devices used to regulate the flow of fluids (e.g., gases, liquids, slurries, etc.) through a passage by opening, closing, or partially obstructing the passage. Valves are used in hundreds of industrial, military, commercial, and even residential applications. Depending on the application, the failure of a valve may potentially result in undesirable consequences such as damage to the system of which the valve is a part, an inability to regulate fluid flow through the valve, and significant repair and downtime expenses.

A common type of valve is a piston-cylinder valve having a piston slidingly disposed within the inner cavity or central bore of a cylinder. Often, an annular seal, which may be seated in a groove around the piston, is provided between the piston and the inside surface of the cylinder wall. By sealingly engaging the inside surface of the cylinder wall, the annular seal prevents the flow of fluids across the piston between the piston and cylinder wall. In addition, an inlet port and an axially spaced apart outlet port are typically provided through the cylinder wall. When the piston is positioned between the inlet port and the outlet port, the piston prevents fluid communication between the inlet port and the outlet port, thereby placing the valve in a "closed" position (e.g., the piston and annular seals block the flow of fluid from the inlet port, through the cylinder cavity, to the outlet port). However, if the piston is not axially positioned between the inlet port and the outlet port, fluid communication between the inlet port and the outlet port is permitted, thereby placing the valve in the "opened" position (e.g., the piston does not block the flow of fluid from the inlet port, through the cylinder cavity, to the outlet port).

In many conventional piston-cylinder valves, a hydraulic or pneumatic actuator is employed to control the movement of the piston within the cylinder, thereby controlling the status of the valve as "opened" or "closed." As the piston is moved between the inlet port and outlet port, or outside the inlet port and outlet port, the piston, and any annular seals around the piston, may cross over one or both ports.

Piston-cylinder valves may be utilized to divert fluid flow in oil or gas production dual-bore wellhead assemblies. For instance, in a subsea oil or gas production well, the wellhead assembly typically includes a tubing hanger having a vertical production bore and at least one vertical annulus bore that is in fluid communication with a tubing annulus and is located below the tubing hanger and between the production tubing and the production casing. In dual-bore wellhead assemblies, two plugs may be required to separately shut off or regulate the flow of fluids into or from the annulus bore, and to shut off the production bore in order to abandon the well or to remove a blow-out preventer (BOP) stack. The running of two separate plugs results in additional equipment and operating costs and time, and decreases the operational flexibility of wellhead assemblies characterized by this dual-bore configuration.

A piston-cylinder valve with typical annular seals that is known in the art may be used to control access to the vertical annulus bore, or tubing annulus, and to regulate the flow of fluids into or from the annulus through the tubing hanger. Valves of this type are typically not integral to the downhole equipment they are intended to serve, and as a result are not easily installed, accessed, removed or replaced. As such, the installation or removal of these non-integral valves may require the removal of conflicting upstream wellhead equipment, thereby disturbing wellhead operations. Further, the failure of the annular seal in the piston-cylinder valve may require a shutdown of the producing well, and necessitate accessing the piston-cylinder valve by removing upstream equipment such as a Christmas tree or a BOP, pulling the valve from the tubing hanger, and repairing or replacing the valve. A leaking valve or inoperable valve resulting from damage may require replacement or repairs, potentially resulting in significant maintenance costs and downtime. In addition to significant well downtime, such a procedure may result in increased associated cost, such as well as repair and maintenance expenses to access, pull, and repair or replace the failing valve.

Thus, there remains a need to develop methods and apparatus for more flexible wellhead assembly with integral annulus valve configurations, as well as more easily accessible piston-cylinder valve assemblies that overcome some of the foregoing difficulties while providing more advantageous overall results.

BRIEF SUMMARY OF SOME OF THE PREFERRED EMBODIMENTS

These and other needs in the art are addressed in one embodiment by an integral annulus shutoff valve. In an embodiment, the integral annulus shutoff valve comprises a sliding piston disposed within a tubing hanger body. In addition, the tubing hanger body comprises a plurality of flowby conduits allowing for fluid flow through the tubing hanger body. The sliding piston is operable to prevent fluid flow between at least two spaced apart flowby conduits, where one of the flowby conduits is capable of being fluidly connected with an annulus bore located below the tubing hanger body. Further, the tubing hanger body may comprise a plurality of pressurizing conduits capable of delivering pressurizing fluid to respective actuation chambers such that the sliding piston may be shifted from an opened to closed position and vice versa.

These and other needs in the art are addressed in another embodiment wherein the integral annulus shutoff valve is disposed as part of a wellhead assembly. In one embodiment, the wellhead assembly comprises a tubing hanger assembly and a Christmas tree. In addition, the tubing hanger assembly comprises a wireline plug disposed in a central production bore. The tubing hanger assembly comprises the sliding piston embodiment described above, which is operable to selectively control fluid flow through the tubing hanger body and into the annulus bore. Further, the tubing hanger assembly and Christmas tree are separately retrievable from the wellhead assembly as a result of the positioning of the wireline plug and integral annulus shutoff valve.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings. It should be appreciated by those skilled in the art that the conception and the specific embodiments disclosed may be readily utilized as a basis for modifying or designing other structures for carrying out the same purposes of the embodiments described herein. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
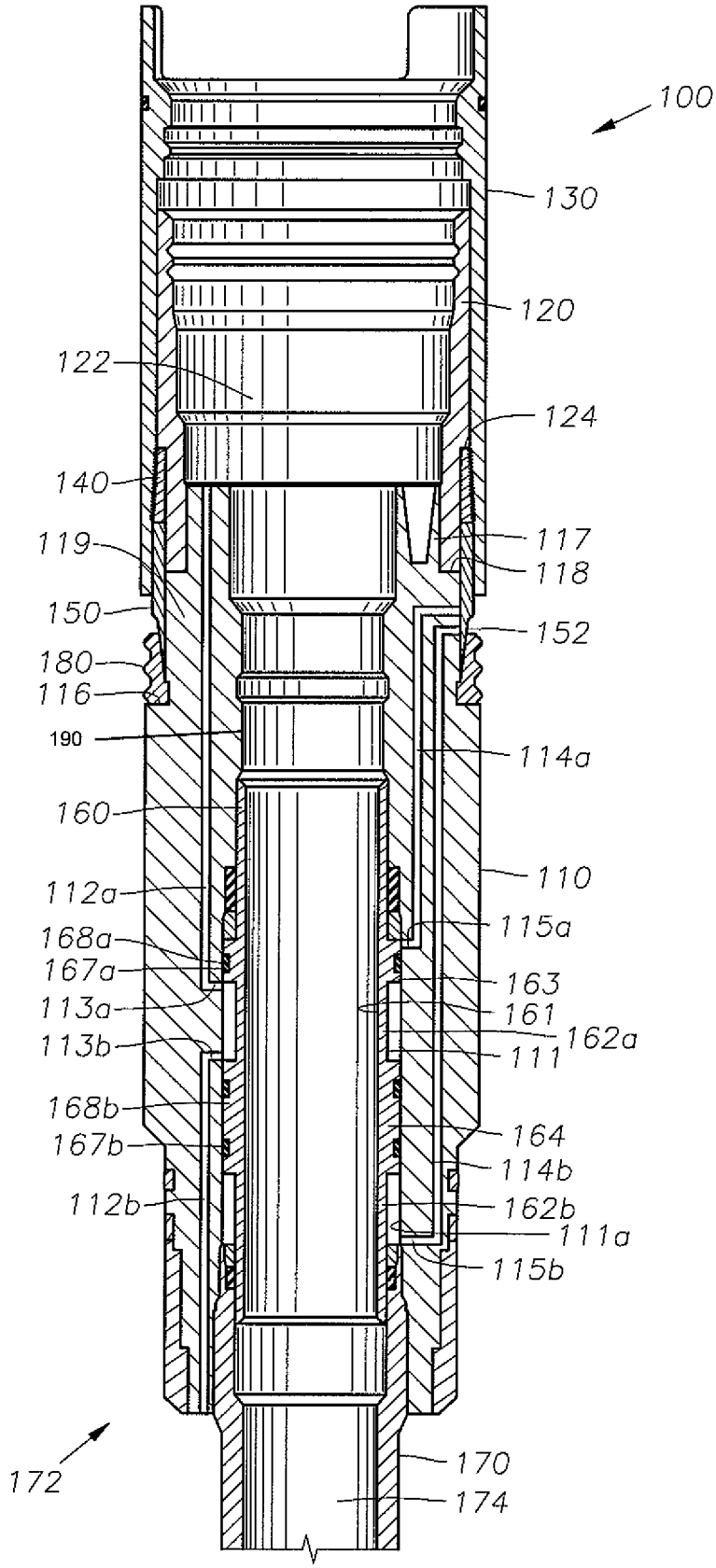
FIG. 1 is a cross-sectional view of an embodiment of a tubing hanger assembly with integral annulus shut off valve.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices and connections. Further, as used herein, the phrase "fluidly connected" or "in fluid communication" means that the components are interconnected in a manner that permits fluid flow therebetween.

FIG. 1 illustrates an embodiment of a tubing hanger assembly 100. Tubing hanger assembly 100 comprises a generally tubular hanger body 110, inner sleeve 120, outer sleeve 130, load ring 140, wedge ring 150, annulus valve piston 160, and locking ring 180. An integral pup for attaching to production tubing pup 170 is disposed at one end of tubing hanger assembly 100. Hanger body 110 is characterized by longitudinal central production bore 190 that is coaxial with production bore 174 of production tubing pup 170, with both production bore 190 and production bore 174 collectively referred to as a production bore. An inner bore 111 is also formed in hanger body 110. A first flow conduit 112*a* and a second flow conduit 112*b* extend longitudinally through hanger body 110, and are fluidly connected on one end with inner bore 111 via first annulus port 113*a* and second annulus port 113*b*, respectively. First flow conduit 112*a* is further fluidly connected with inner sleeve bowl 122, and second flow conduit 112*b* is further fluidly connected with lower annulus bore 172 surrounding production tubing pup 170. First pressurizing conduit 114*a* and second pressurizing conduit 114*b* are provided through hanger body 110.

Although a variety of locking means are contemplated for use with the present device to secure hanger body 110 of tubing hanger assembly 100 within a wellbore tubular member, FIG. 1 illustrates a single representative embodiment of locking means. A split "C" locking ring 180 extends around hanger body 110 and rests on locking shoulder 116 of hanger body 110. As an alternative to the split "C" ring, locking ring 180 may be in the form of a segmented ring. The upper neck portion 117 of hanger body 110 is surrounded by generally tubular inner sleeve 120. Inner sleeve 120 is attached to, coaxial and aligned with hanger body 110, and rests on an upper shoulder 118 of hanger body 110. A generally tubular outer sleeve 130 surrounds and is positioned concentric to inner sleeve 120, and is longitudinally slidable with respect to hanger body 110 and inner sleeve 120. A load ring 140 is disposed between outer sleeve 130 and inner sleeve 120, and is threadingly connected to a lower inner surface of outer sleeve 130. An upper end of load ring 140 initially engages a lower shoulder 124 of inner sleeve 120. A wedge ring 150 is connected to outer sleeve 130 and is located below load ring 140, such that a lower end of load ring 140 engages an upper end of wedge ring 150. The lower outer portion of wedge ring 150 is formed with a tapered surface 152. The lower inner surface of wedge ring 150 contacts an intermediate neck 119 of hanger body 110 directly above locking shoulder 116.

A generally tubular annulus valve piston 160 is disposed concentrically within central production bore 190 of hanger body 110. A vertical bore 161 extends through the annulus valve piston 160 and opens at a first end into the central production bore 190 of hanger body 110. The second end of vertical bore 161 is aligned with and opens to bore 174 of production tubing pup 170. Annulus valve piston 160 may be used to control fluid flow through hanger body 110, and specifically to control fluid flow through first flow conduit 112*a* and second flow conduit 112*b*. To that end, annulus valve piston 160 may be characterized by at least a first radial protrusion extending from the outer surface 162*a*, and a second radial protrusion extending from outer surface 162*b*. In certain embodiments, an upper shoulder 163 may serve as the first radial protrusion, and a lower shoulder 164 may serve as the second radial protrusion. Outer surfaces 162*a* and 162*b* of annulus valve piston 160 have a first diameter, and upper shoulder 163 and lower shoulder 164 are at a second, larger diameter. The second diameter value of upper shoulder 163 and lower shoulder 164 is such that the outer surfaces of upper shoulder 163 and lower shoulder 164 engage the inner surface 111*a* of inner bore 111.

Upper and lower annular seals 167*a* and 167*b* may be disposed in upper and lower circumferential grooves 168*a* and 168*b* located respectively on the outer surfaces of upper shoulder 163 and lower shoulder 164. Upper and lower annular seals 167*a* and 167*b* sealingly engage the inner surface 111*a* of inner bore 111, thereby preventing the flow of fluid axially across annulus valve piston 160 and between annulus valve piston 160 and hanger body 110. In certain embodiments, upper and lower annular seals 167*a* and 167*b* may comprise O-ring type seals. Upper and lower annular seals 167*a* and 167*b* may alternatively be disposed in grooves in inner surface 111*a* of inner bore 111 such that seals 167*a* and 167*b* sealingly engage the outer surfaces of upper shoulder 163 and lower shoulder 164, respectively.

Figure 2A:
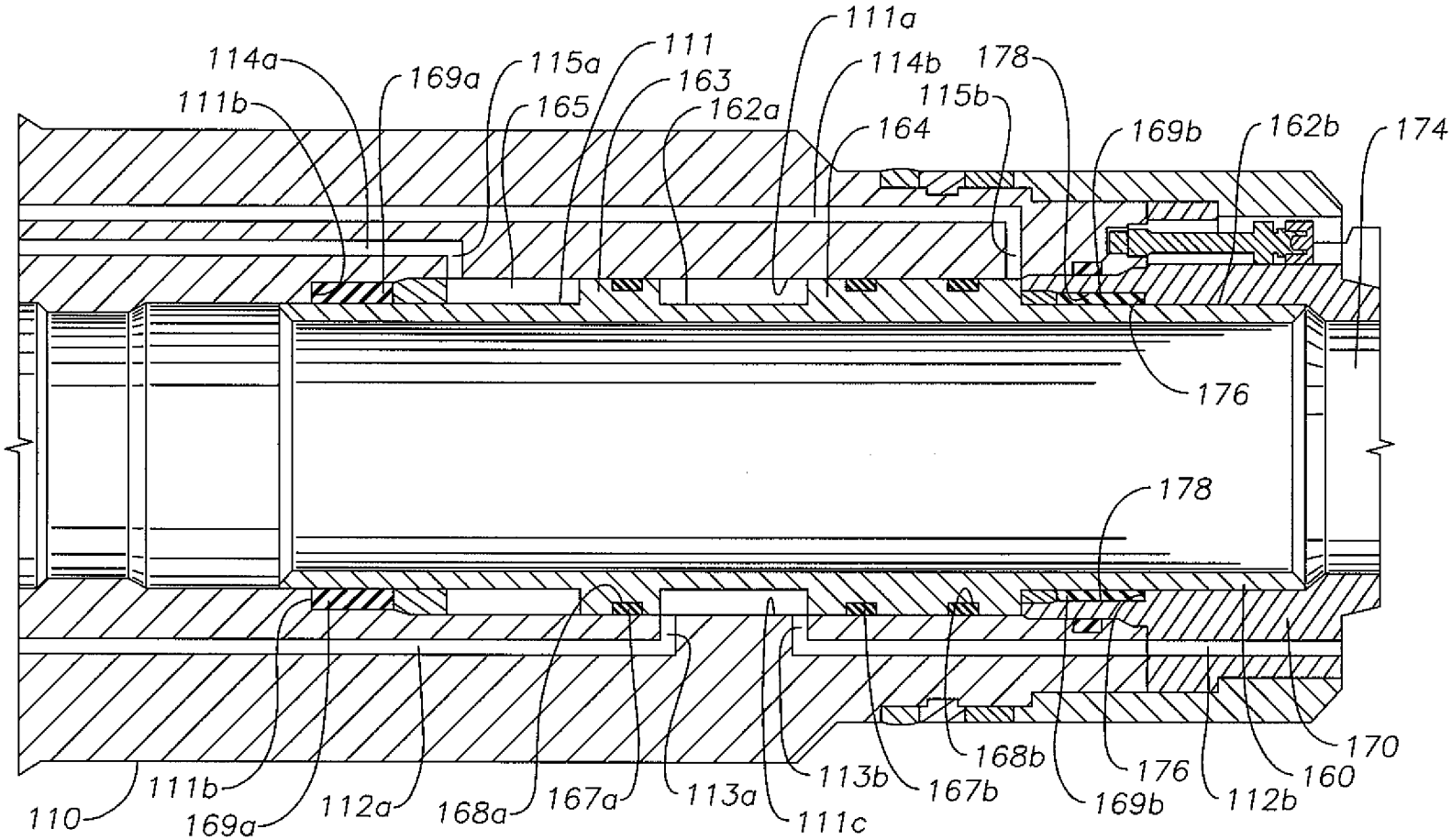
FIG. 2A is an enlarged cross-sectional view of the annulus shut off valve piston of FIG. 1 in the "opened" position.
Figure 2B:
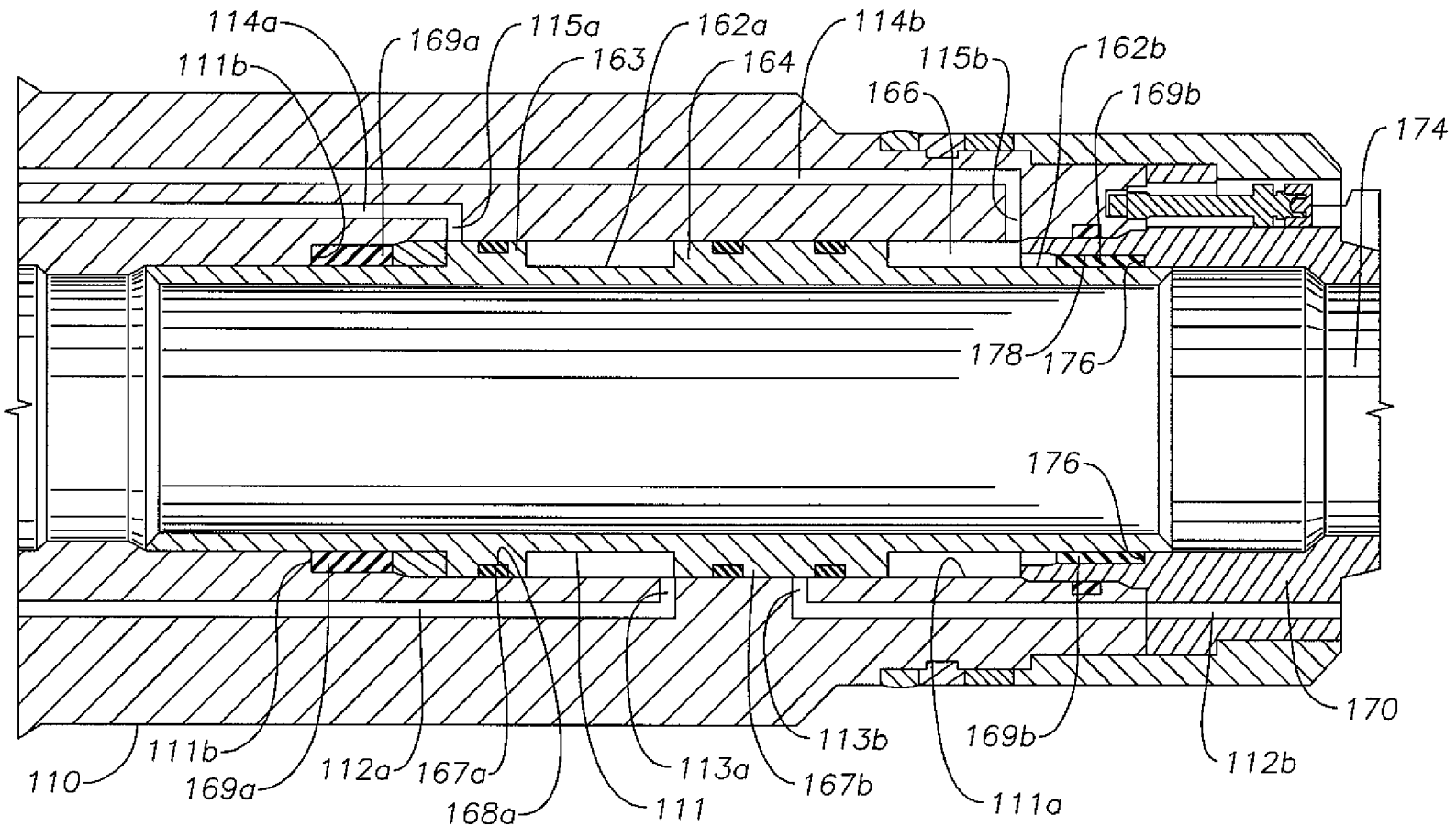
FIG. 2B is an enlarged cross-sectional view of the annulus shut off valve piston of FIG. 1 in the "closed" position.

Referring now to FIGS. 2A and 2B, upper hanger seal 169*a* is disposed below inner shoulder 111*b* of hanger body 110, and is located between inner surface 111*a* of hanger body 110 and outer surface 162*a* of annulus valve piston 160, and engages an upper portion of outer surface 162*a* of annulus valve piston 160. Similarly, lower hanger seal 169*b* is disposed above upper end 176 of production tubing pup 170, and between an inner upper surface 178 of production tubing pup 170 and outer surface 162*b* of annulus valve piston 160, and engages a lower portion of outer surface 162*b* of annulus valve piston 160. Upper hanger seal 169*a* and lower hanger seal 169*b* provide sealing engagement at the respective contact points between annulus valve piston 160 and hanger body 110, as well as annulus valve piston 160 and production tubing pup 170, so as to prevent fluid flow across annulus valve piston 160 and out of production bore 190.

Upper and lower annular seals 167*a* and 167*b* may comprise any suitable material, including without limitation nonmetals (e.g., polymer, elastomer, ceramic, etc.), composites, or combinations thereof. In certain embodiments, upper and lower annular seals 167*a* and 167*b* preferably comprise an elastomer such as nitrile rubber, or a polymer, or PEEK®. In some embodiments in which upper and lower annular seals 167*a* and 167*b* comprises PEEK®, a resilient member (not shown) may be included in upper and lower circumferential grooves 168*a* and 168*b* between seals 167*a* and 167*b* and annulus valve piston 160 to exert forces on upper and lower annular seals 167*a* and 167*b*, thereby tending to maintain upper and lower annular seals 167*a* and 167*b* in sealing engagement with inner surface 111*a* of hanger body 110. Upper and lower hanger seals 169*a* and 169*b* may be comprised of pack-offs of conventional design, and may comprise any suitable material, including without limitation metals (e.g., tin, copper, etc.), composites, or combinations thereof.

Referring still to FIGS. 2A and 2B, hanger body 110 is shown with annulus valve piston 160 disposed within central production bore 190 of hanger body 110. When annulus valve piston 160 is disposed within hanger body 110, an inner flowby chamber 111*c* is created between upper shoulder 163 and lower shoulder 164. Additionally, first actuation chamber 165 is created in the annular space above upper shoulder 163 and below inner shoulder 111*b* of hanger body 110. The first actuation chamber 165 is further defined by the annular space between outer surface 162*a* of annulus valve piston 160 and the inner surface 111*a* of inner bore 111. A second actuation chamber 166 is created in the annular space between lower shoulder 164 and an upper end of production tubing pup 170. The second actuation chamber 166 is further defined by a second, downhole annular space between outer surface 162*b* of annulus valve piston 160 and the inner surface 111*a* of inner bore 111. First actuation port 115*a* is located to correspond with the position of first actuation chamber 165, such that first actuation port 115*a* is in fluid communication with first actuation chamber 165. Second actuation port 115*b* is located to correspond with the position of second actuation chamber 166, such that second actuation port 115*b* is in fluid communication with second actuation chamber 166. First pressurizing conduit 114*a* is in fluid communication with first actuation chamber 165 via first actuation port 115*a*, and second pressurizing conduit 114*b* is in fluid communication with second actuation chamber 166 via second actuation port 115*b*.

Annulus valve piston 160 is slidable longitudinally with respect to hanger body 110 between a first, opened position (as shown in FIG. 2A), and a second, closed position (as shown in FIG. 2B). Specifically, the outer surfaces of upper shoulder 163 and lower shoulder 164 of annular valve piston 160 slidingly engage inner surface 111*a* of inner bore 111. Thus, annular valve piston 160 is permitted to move axially within production bore 190 of hanger body 110. Referring to FIG. 2A, the engagement between lower shoulder 164 and upper end 176 of production tubing pup 170 prevents additional downward movement of annulus valve piston 160 beyond the opened position. Similarly, referring to FIG. 2B, the engagement between upper shoulder 163 and inner shoulder 111*b* prevents additional upward movement of annulus valve piston 160 beyond the closed position. As will be described in more detail below, pressurized fluid from an outside source (not shown) is transferred via upper pressurizing conduit 114*a* and lower pressurizing conduit 114*b* through upper actuation port 115*a* and lower actuation port 115*b* to first actuation chamber 165 and second actuation chamber 166 in order to actuate annulus valve piston 160 from the "opened" position illustrated in FIG. 2A to the "closed" position illustrated in FIG. 2B, and vice versa.

In general, when annulus valve piston 160 is in the "closed" position illustrated in FIG. 2B, first flow conduit 112*a* and second flow conduit 112*b* are not in fluid communication. Moreover, second flow conduit 112*b* is not in fluid communication with inner flowby chamber 111*c* of inner bore 111. Specifically, lower annulus port 113*b* is blocked by the combination of lower shoulder 164 and lower annular seal 167*b*, thereby preventing fluid flow from or into lower annulus port 113*b*. Thus, as used herein, the term "closed" and "closed position" refer to configurations of annulus valve piston 160, lower shoulder 164, and lower annular seal 167*b*, in which fluid communication between spaced apart annulus flowby ports (e.g., upper annulus port 113*a* and lower annulus port 113*b*) and annular spaces outside of hanger body 110, such as lower annulus bore 172 below hanger body 110, and production bore 190 in hanger body 110, is prevented. Annulus valve piston 160 is maintained in its "closed" position by fluid pressure introduced into second actuation chamber 166 via second actuation port 115*b*. Pressurized fluid from an outside source acts on lower shoulder 164, thereby constraining annulus valve piston 160 in the closed position with upper shoulder 163 engaging inner shoulder 111*b* of hanger body 110.

Still referring to FIGS. 2A and 2B, by controlling the location of annulus valve piston 160 within production bore 190 of hanger body 110 with the balancing of fluid pressures in first actuation chamber 165 and second actuation chamber 166, annulus valve piston 160 may be configured between "opened" and "closed" positions. Prior to operation, annulus valve piston 160 may be pressure balanced with respect to production bore 190 and lower annulus bore 172. In operation, annulus valve piston 160 may be moved downward from the closed position to the opened position by increasing the amount of pressurized fluid in first actuation chamber 165 via first actuation port 115*a* and first pressurizing conduit 114*a*, and the reducing the amount of pressurized fluid in second actuation chamber 166 via second actuation port 115*b* and second pressurizing conduit 114*b*. In certain embodiments, hydraulic fluid may be used as the pressurizing fluid. The flow of hydraulic fluid may be controlled by any suitable means, and without limitation may be manually controlled, electronically controlled, computer controlled, remotely controlled, or combinations thereof.

Annulus valve piston 160 may be moved from the "closed" position to the "opened" position. When piston 160 is in the closed position, the hydraulic pressure in second actuation chamber 166 is greater than that in first actuation chamber 165. In order to move piston 160 to the opened position, the fluid pressure in second actuation chamber 166 is reduced at the same time the fluid pressure in first actuation chamber 165 is increased via first pressurizing conduit 114*a* and first actuation port 115*a*. As a result of the change in relative fluid pressure in first actuation chamber 165 and second actuation chamber 166, piston 160 moves downward axially due to the fluid pressure gradient acting on upper shoulder 163.

As piston 160 moves axially within production bore 190 due to the fluid pressure gradient across first actuation chamber 165 and second actuation chamber 166, lower shoulder 164 and lower annular seal 167*b* begin to also move downward and begin to clear and unseal lower annulus port 113*b*. The fluid pressure in first actuation chamber 165 is increased until piston 160 attains the opened position, such that lower shoulder 164 and lower annular seal 167*b* of piston 160 have moved sufficiently to permit fluid communication through lower annulus port 113*b* between second flow conduit 112*b*, first flow conduit 112*a* via inner chamber 111*c* of inner bore 111. In the "opened" configuration, the flow of fluids is thereby permitted from first flow conduit 112*a* to second flow conduit 112*b*, or vice versa depending on the relative pressures between first flow conduit 112*a* and second flow conduit 112*b*.

Once lower shoulder 164 of piston 160 engages upper end 176 of production tubing pup 170, annulus valve piston 160 is prevented from further axial movement relative to hanger body 110 and is constrained in the opened position. At this point, the fluid pressure present in first actuation chamber 165 is stabilized, thereby holding piston 160 in the opened position due to the force of the fluid pressure on upper shoulder 163. As shown in FIG. 2A, piston 160, lower shoulder 164, and lower annular seal 167*b* have achieved the full "opened" position in which there are no obstructions between lower annulus port 113*b*, upper annulus port 113*b*, and inner bore 111 (e.g., lower annulus port 113*b* is fully opened).

From the fully "opened" position illustrated in FIG. 2A, annulus valve piston 160 may be repositioned to the "closed" position shown in FIG. 2B by adjusting the relative fluid pressure gradient in first actuation chamber 165 and second actuation chamber 166. In operation, the fluid pressure in first actuator chamber 165 is reduced as the pressure in second actuation chamber 166 is increased. In response to the change in fluid pressure gradient in first actuation chamber 165 relative to second actuation chamber 166, piston 160 begins to move axially relative to hanger body 110 in an upward direction.

Figure 2C:
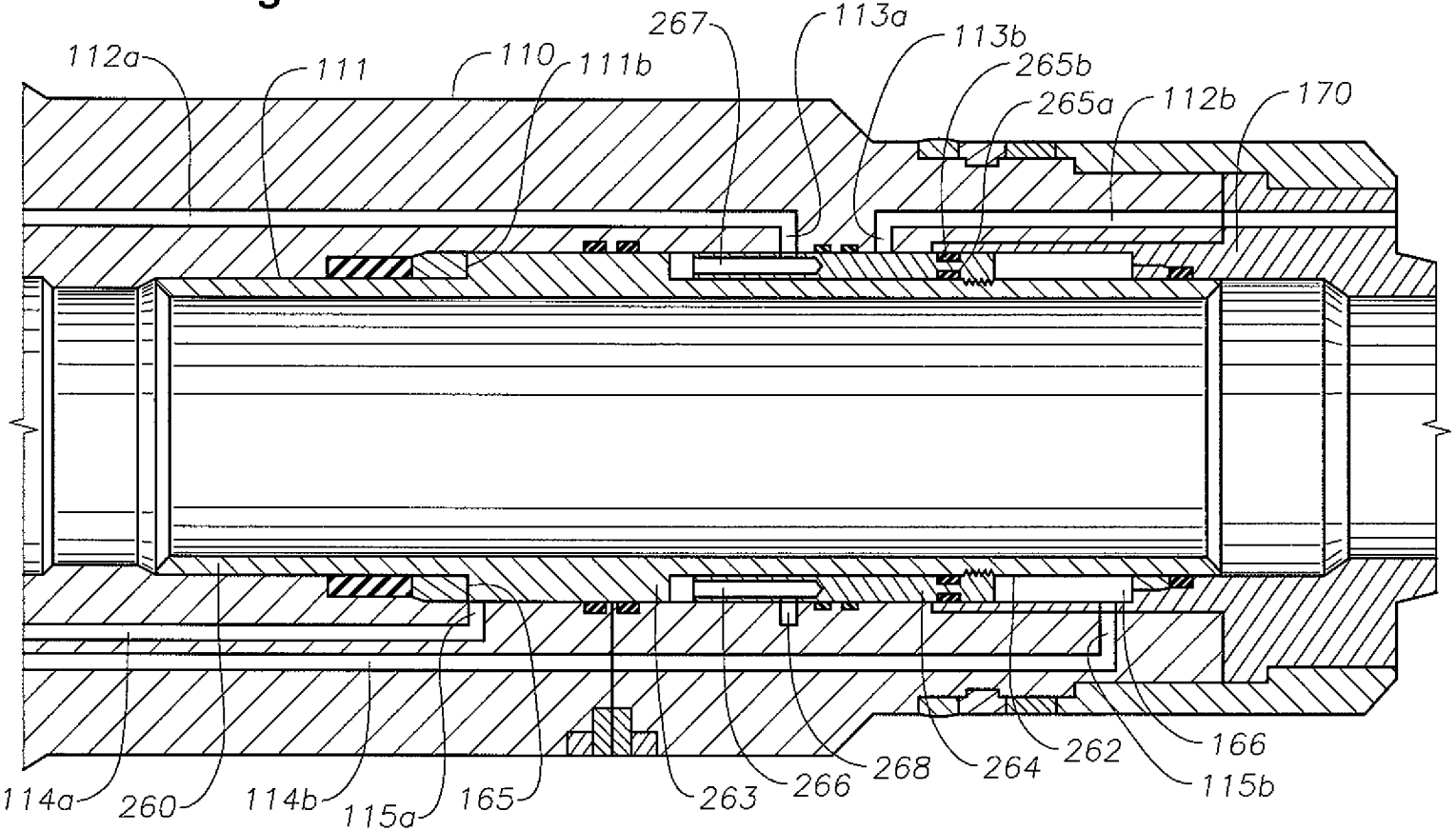
FIG. 2C is a cross-sectional view of an annulus valve piston and valve sleeve combination in the "closed" position.

Referring now to FIG. 2C, in alternative embodiments an annulus valve piston 260 in combination with a valve sleeve 264 may be used to control fluid flow through hanger body 110. Annulus valve piston 260 may be characterized by an outer surface 262 and a circumferential shoulder 263, which functions as the first radial protrusion from outer surface 262 of annulus valve piston 260. Valve sleeve 264 is secured at one end to outer surface 262 and disposed below circumferential shoulder 263 on annulus valve piston 260, and may function as the second radial protrusion from outer surface 262. Valve sleeve 264 is further characterized by circumferential seals 265*a* and 265*b*, which are disposed between outer surface 262 and sleeve 264, and sleeve 264 and production tubing pup 170, respectively. An inner passage 266 is disposed through sleeve 264, and is defined on opposed ends by a longitudinal opening 267 and a radial opening 268. Inner passage 266 may be described as being "L-shaped" in that the central axes defining longitudinal opening 267 and radial opening 268 are oriented perpendicular to each other.

Referring still to FIG. 2C, hanger body 110 is shown with the annulus valve piston 260 and valve sleeve 264 combination disposed within central production bore 190 of hanger body 110. A first actuation chamber 165 is created in the annular space above circumferential shoulder 263 and below inner shoulder 111*b* of hanger body 110. A second actuation chamber 166 is created in the annular space between valve sleeve 264 and an upper end of production tubing pup 170. First actuation port 115*a* is located to correspond with the position of first actuation chamber 165, such that first actuation port 115*a* is in fluid communication with first actuation chamber 165. Second actuation port 115*b* is located to correspond with the position of second actuation chamber 166, such that second actuation port 115*b* is in fluid communication with second actuation chamber 166.

When the annulus valve piston 260 and valve sleeve 264 combination is in the "closed" position illustrated in FIG. 2C, first flow conduit 112*a* and second flow conduit 112*b* are not in fluid communication. Specifically, lower annulus port 113*b* is blocked by valve sleeve 264, thereby preventing fluid flow from or into second flow conduit 112*b* via lower annulus port 113*b*. Further, in the "closed" configuration shown, radial opening 268 is aligned with and in fluid communication with upper annulus port 113*a*. As a result, any fluid flow through first flow conduit 112*a* travels through upper annulus port 113*a* and into inner passage 266 via radial opening 268. Because longitudinal opening 267 is adjacent to circumferential shoulder 263 in this configuration, the fluid flow is blocked by valve sleeve 264 and constrained between inner passage 266 and circumferential shoulder 263.

Figure 2D:
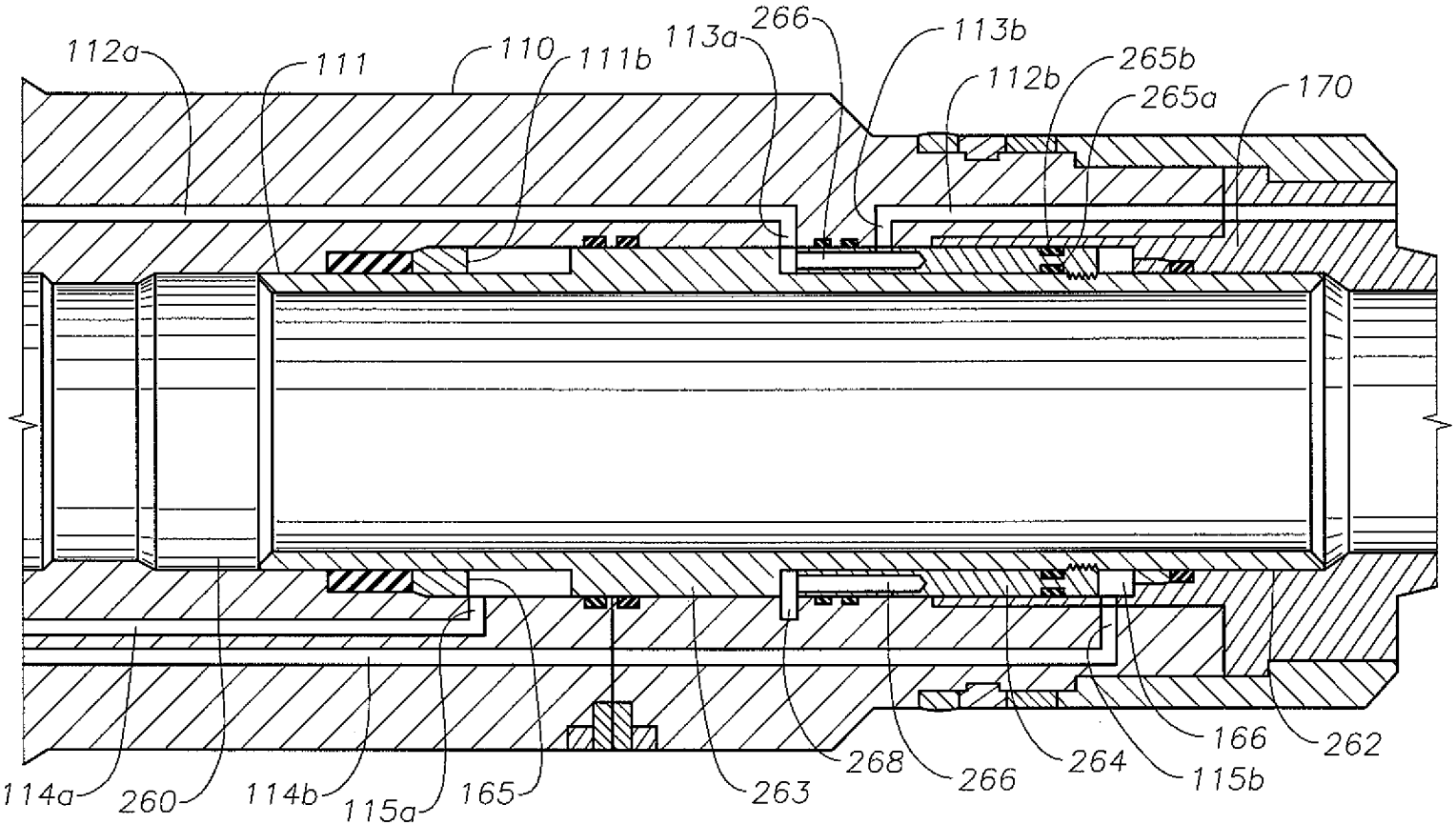
FIG. 2D is a cross-sectional view of an annulus valve piston and valve sleeve combination in the "opened" position.

Similar to the manner of operation described above, the embodiment comprising the annulus valve piston 260 and valve sleeve 264 combination may be alternated between "opened" and "closed" positions by controlling the fluid pressure gradient across first actuation chamber 165 and second actuation chamber 166. Referring now to FIG. 2D, the annulus valve piston 260 and valve sleeve 264 combination is shown in the "opened" position. In the "opened" position, fluid flow is permitted between first flow conduit 112*a* and second flow conduit 112*b* through an inner flowby chamber 111*c* created adjacent to upper annulus port 113*a* and between circumferential shoulder 263 and valve sleeve 264. Inner flowby chamber 111*c* is in fluid communication on one end with upper annulus port 113*a*, and on an opposite end with longitudinal opening 267. Further, radial opening 268 is aligned with and in fluid communication with lower annulus port 113*b*. As a result, fluid flow from first flow conduit 112*a* to second flow conduit 112*b* is allowed through inner passage 266. When the annulus valve piston 260 and valve sleeve 264 combination are oriented in the "opened" configuration, fluid from first flow conduit 112*a* may enter inner flowby chamber 111*c*, and pass through inner passage 266 into second flow conduit 112*b*.

Figure 3:
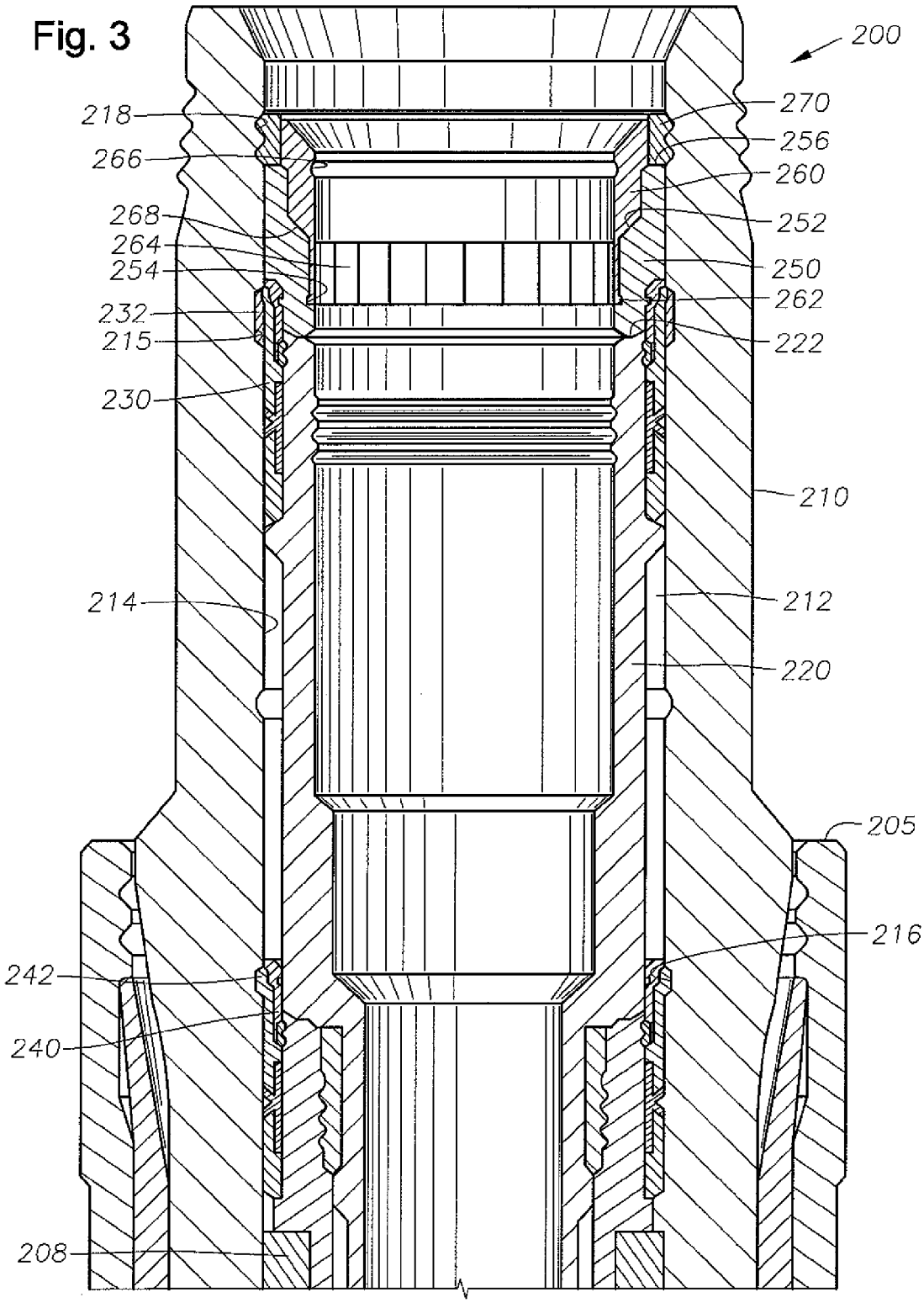
FIG. 3 is a cross-sectional view of a wellhead assembly.

Referring now to FIG. 3, one embodiment of wellhead assembly 200 is shown. Wellhead assembly 200 comprises a high-pressure housing 210, wherein high-pressure housing 210 is installed on housing 205. High-pressure housing 210 is generally tubular and comprises a longitudinal central bore 212. Generally tubular casing hangers 208 and 220 are landed within bore 212 of high-pressure housing 210. A first annular pack-off 230 of conventional design seals the casing hanger 220 to the inner wall 214 of the high-pressure housing 210. The first annular pack-off 230 comprises a first locking ring 232, engaged with an upper circumferential groove 215 in the inner wall 214 of the high-pressure housing 210. Second annular pack-off 240 locks down casing hanger 208, and comprises a second locking ring 242, engaged with a lower circumferential groove 216 in the inner wall 214 of the high-pressure housing 210. The first and second locking rings 232 and 242 serve to retain the casing hangers 220 and 208 in position within the high-pressure housing 210, and permit casing hangers 220 and 208 only limited movement longitudinally within the central bore 212 of high-pressure housing 210.

The upper portion of casing hanger 220 is formed with a seating surface 222 that allows an annular ring 250 to seat on casing hanger 220 within the central bore 212 of high-pressure housing 210. Annular ring 250 has an inner tapered surface 252, forming a seat on which may be landed annular snap collar 260. Annular snap collar 260 is generally tubular, and is characterized by a central bore therethrough and a circumferential lip 262 at a first end. The first end of annular snap collar 260 is further comprised of a series of equally-spaced spring elements 264, wherein circumferential lip 262 is present on each spring element 264. The annular snap collar 260 is slidable longitudinally with respect to annular ring 250 between a first, upper position, and a second, lower position.

A running tool (not shown) is used to engage an internal groove 266 on annular snap collar 260, and to apply a downward force to insert annular snap collar 260 into annular ring 250, such that spring elements 264 deflect inward, and then spring back to their original configuration as an outer tapered surface 268 of annular snap collar 260 engages complimentary inner tapered surface 252 of annular ring 250. Simultaneous with annular snap collar 260 coming to rest on inner tapered surface 252, the deflection of spring elements 264 cause circumferential lip 262 to engage a lower circumferential groove 254 located within the central bore of annular ring 250, such that the engagement of circumferential lip 262 with inner circumferential groove 254 locks annular snap collar 260 into position.

A split "C" locking ring 270 extends around an outer surface of annular snap collar 260 and rests on an upper shoulder 256 of annular ring 250. The locking ring 270 is formed to be engageable with a pair of locking grooves 218 formed in the inner wall 214 of high-pressure housing 210. As an alternative to the split "C" ring, the locking ring 270 may be in the form of a segmented ring. As annular snap collar 260 is forced downward into position such that it is seated with respect to annular ring 250, the outer surface of annular snap collar 260 engages with locking ring 270 and urges it radially outward into engagement with the locking grooves 218. As described above, the downward movement of annular snap collar 260 is limited by outer tapered surface 268 contacting the corresponding inner tapered surface 256 on annular ring 250. Annular ring 250, annular snap collar 260, and locking ring 270 are provided in order to accommodate pressure uploads tending to push tubing hanger assembly 100 upward when positioned in its "as-installed" position.

Figure 4A:
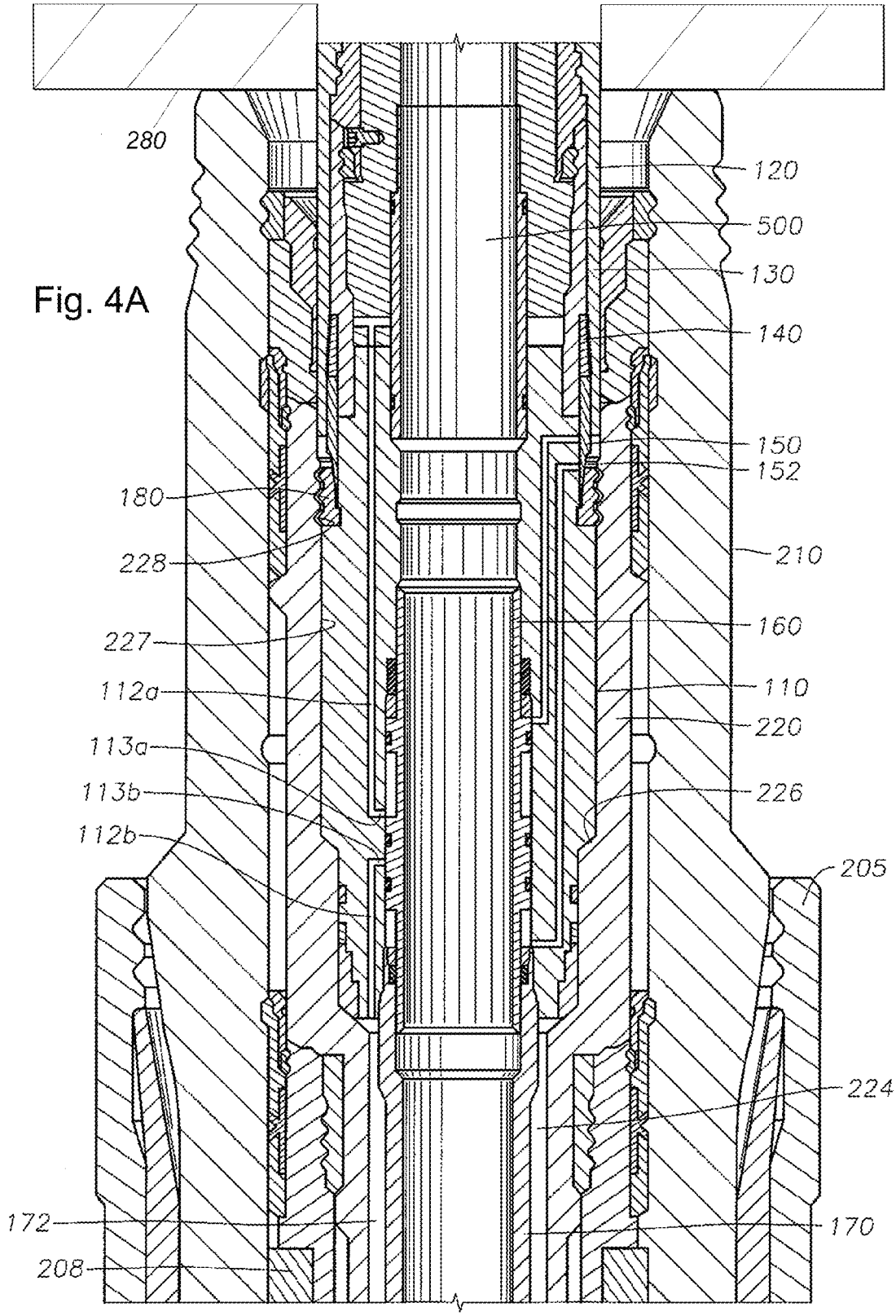
FIG. 4A is a cross-sectional view of the wellhead assembly of FIG. 3 with a christmas tree installed and with the tubing hanger assembly of FIG. 1 employed therein and the annulus shut off valve in the "closed" position.

Referring now to FIG. 4A, in one embodiment tubing hanger assembly 100 is shown landed within a wellbore tubular member such as casing hanger 220, retained by an internal form 226 within the central bore 224 of casing head 220. As discussed above, the casing head 220 is landed within a high-pressure housing 210 such as, in this example, a wellhead housing. Installed above the wellhead housing 210 is a christmas tree 280 (only the lower portion of which is shown). The christmas tree 280 is installed such that the tubing hanger assembly 100 and the tree 280 are independently retrievable from the wellhead assembly 210. Tubing hanger running tool 500 (partially shown) is inserted into outer sleeve 130 and applies a downward force to outer sleeve 130. The downward force applied to outer sleeve 130 causes the downward longitudinal movement of outer sleeve 130, which is translated to load ring 140 and wedge ring 150. As a result, load ring 140 and wedge ring 150 are forced downward with respect to hanger body 110. Outer sleeve 130, load ring 140, and wedge ring 150 are slidable longitudinally with respect to hanger body 110 between a first, upper position, and a second, lower position. In the first position, the tapered surface 152 of wedge ring 150 contacts the upper edge of locking ring 180. Upon downward movement of outer sleeve 130, load ring 140, and wedge ring 150 from the first position to the second position, the tapered surface 152 of the wedge ring 150 engages with the locking ring 180 and urges it radially outward into engagement with the locking grooves 228 in the inner surface 227 of casing hanger 220. As a result, hanger body 110 is constrained in place due to the engagement between the lower edge of locking ring 180 with upper shoulder 118 of hanger body 110, and the engagement of locking ring 180 within the locking grooves 228 of casing hanger 220.

Figure 4B:
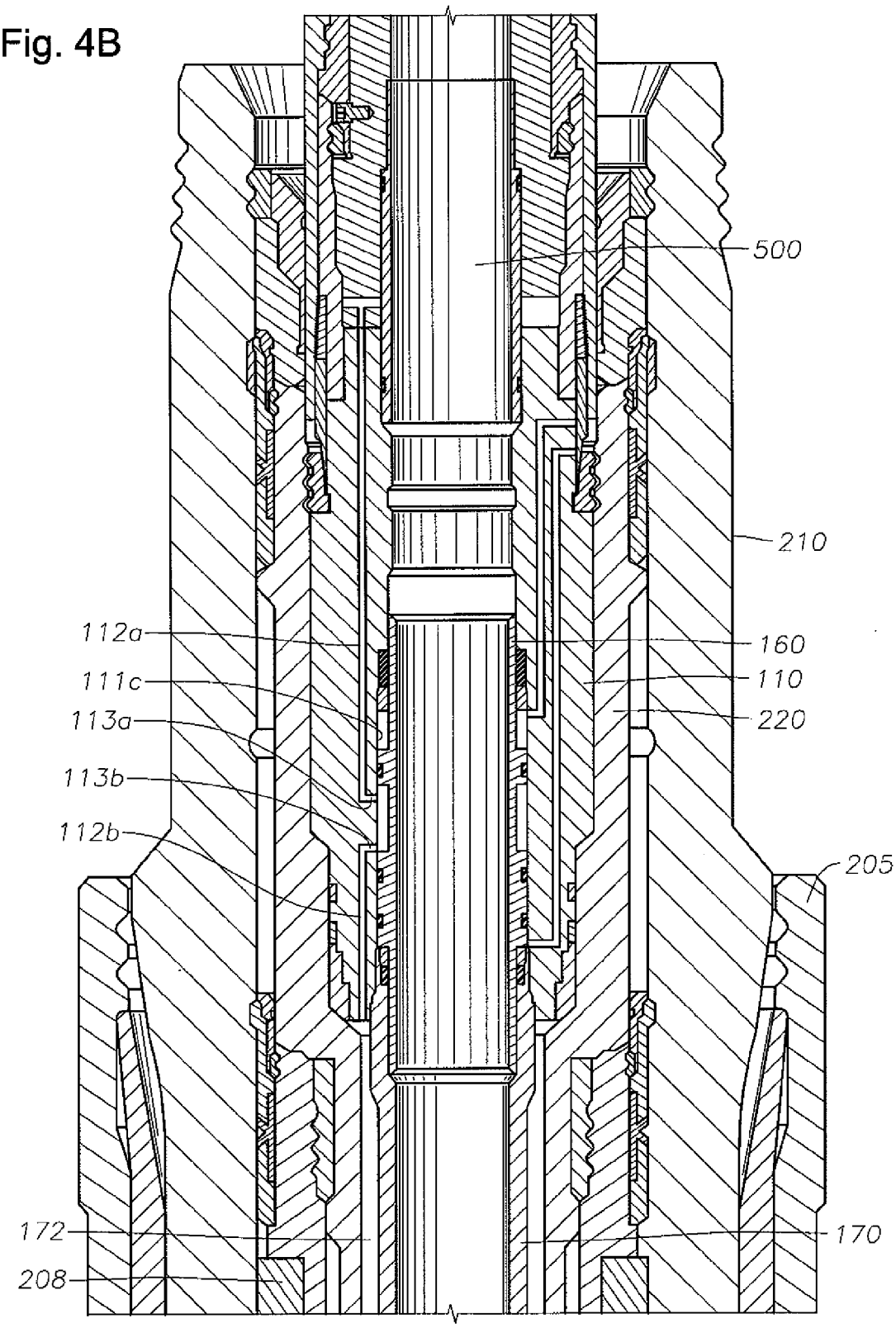
FIG. 4B is a cross-sectional view of the wellhead assembly of FIG. 3 with the tubing hanger assembly of FIG. 1 employed therein and the annulus shut off valve in the "opened" position.

The embodiment of tubing hanger assembly shown in FIGS. 4A-4B is further comprised by an annulus valve piston 160 that is substantially the same, and operates in substantially the same manner, as annulus valve piston 160 described above with reference to FIGS. 2A-2B. In certain embodiments, annulus valve piston 160 is "opened" and "closed" as described above in reference to FIGS. 2A-2B, respectively. As employed in certain embodiments of tubing hanger assembly 100, annulus valve piston 160 permits selective and controlled access to lower annulus bore 172 defined by production tubing pup 170 and casing hanger 220 located within a wellbore. Specifically, annulus valve piston 160 is used to control the flow of fluids to and from lower annulus bore 172 when tubing hanger assembly 100 is disposed within wellhead assembly 200.

As described above, hanger body 110 of tubing hanger assembly 100 comprises a first flow conduit 112*a* capable of providing fluid communication between inner chamber 111*c* of inner bore 111 and a region above hanger body 110 (e.g., inner sleeve bowl 122) through first annulus port 113*a*. Hanger body 110 also comprises a second flow conduit 112*b* capable of providing fluid communication between inner chamber 111*c* of inner bore 111 and a region below hanger body 110 (e.g., lower annulus bore 172) through second annulus port 113*b*. In the manners previously described, by controlling the position of annulus valve piston 160 within production bore 190, tubing hanger assembly 100 may be placed in an "opened" or "closed" position as desired. When annulus valve piston 160 is in the "closed" position (e.g., FIGS. 2A and 2B), second annulus port 113*b* and second flow conduit 112*b* are not in fluid communication with inner chamber 111*c* of inner bore 111, and therefore fluid flow is prevented to or from lower annulus bore 172 via second flow conduit 112*b*. However, when annulus valve piston 160 is in the "opened" position (e.g., FIGS. 2A and 4B), second flow conduit 112*b* is fluidly connected with inner chamber 111*c* of inner bore 111 via second annulus port 113*b*, thereby placing lower annular bore 172 into fluid communication with inner chamber 111*c*. As a result, when annulus valve piston 160 is in the "opened" position, fluid may flow through hanger body 110 into lower annular bore 172. Thus, by selectively actuating annular valve piston 160 (i.e., controlling the position of annular valve piston 160 with respect to second annulus port 113*b*), tubing hanger assembly 100 may be used to control flow fluids to or from lower annulus bore 172.

In the manner described, embodiments of the tubing hanger assembly 100 described herein (e.g., those including integral annulus valve piston 160) permit the selective control of fluid flow between two physically separated environments (e.g., inner sleeve bowl 122 and lower annulus bore 172). The integral configuration of annulus valve piston 160 within tubing hanger assembly 100 results in a flexible apparatus that can be used to overcome several of the shortcomings in previous dual-bore tubing hanger designs. In the current embodiments, tubing hanger assembly 100 may be removed from casing hanger 220 without disturbing a separately retrievable Christmas tree that may be mounted above. Moreover, the current embodiments allow for the removal of the Christmas tree without disturbing tubing hanger assembly 100.

Figure 5:
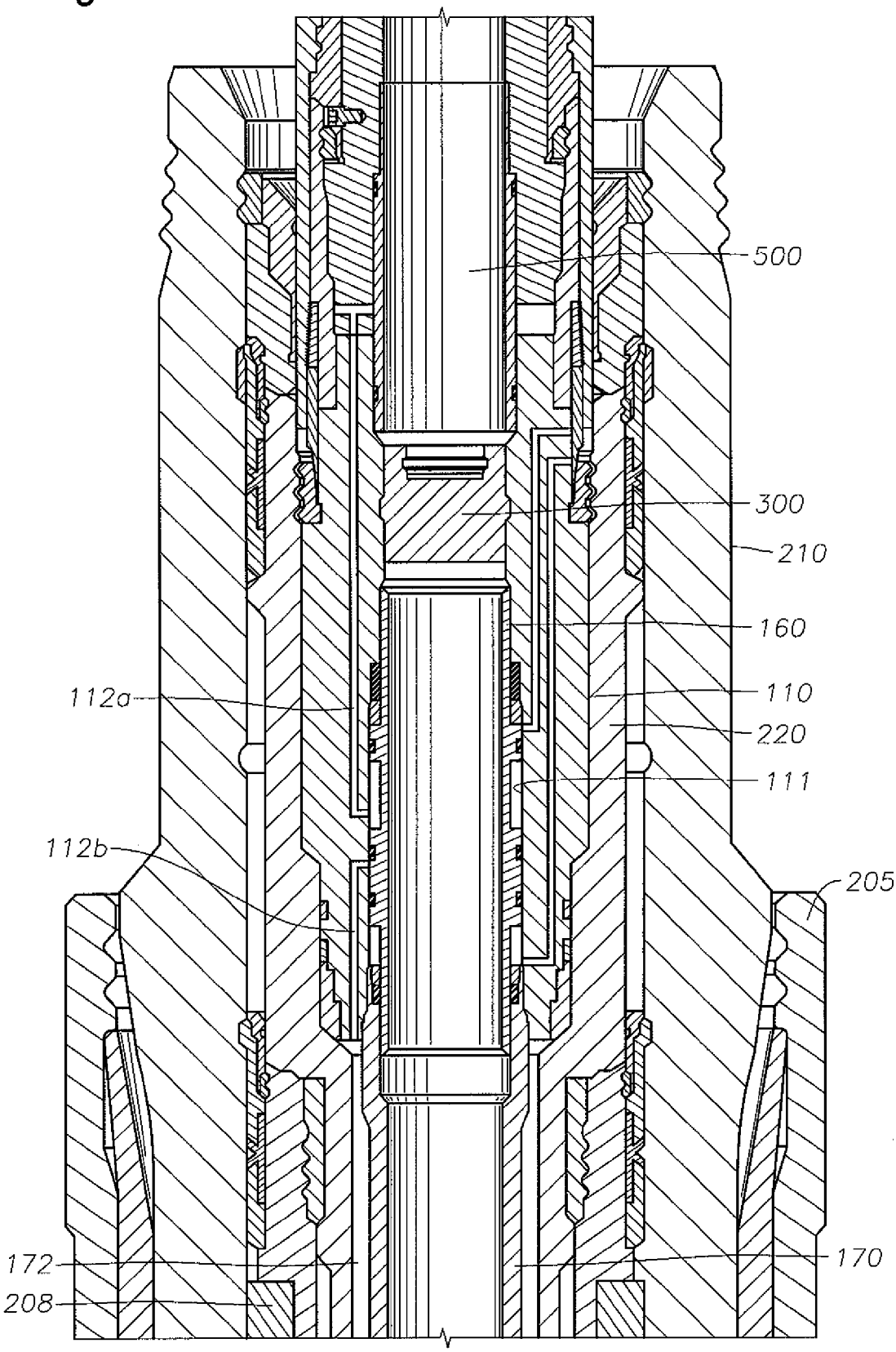
FIG. 5 is an embodiment of a tubing hanger assembly in a wellhead assembly including a wireline plug.

Referring now to FIG. 5, tubing hanger assembly 100 is shown disposed within casing hanger 220. Annulus valve piston 160 is shown in the "closed" position, such that fluid flow through hanger body 110 to lower annulus bore 172 through first flow conduit 112*a* and second flow conduit 112*b* is prevented. A wireline plug 300 of conventional design is shown in FIG. 5 installed in the central production bore 190 of hanger body 110. With annulus valve sleeve piston 160 in the "closed" position and plug 300 positioned to shut off any fluid flow from production tubing pup 170, the wellbore may be completed sealed. As such, any equipment located above tubing hanger assembly 100, such as a Christmas tree or blow-out preventer (BOP) may be removed without disturbing tubing hanger assembly 100.

Additionally, it should be noted that the integral configuration of annulus valve sleeve 160 within tubing hanger assembly 100 provides the benefit of allowing a relative reduction in the diameter of hanger body 110. The relatively small diameter of hanger body 110 with respect to a Christmas tree or BOP located on the wellhead makes it possible to fit tubing hanger assembly 100 through either a Christmas tree or BOP. As a result, the need for a separate trip to plug a wellbore, or the need for an additional piece of large, expensive equipment, to completely seal fluid flow in the previous dual-bore wellhead configurations is eliminated.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A tubing hanger assembly for a production tubing comprising:

a hanger body including a central bore, a first conduit, and a second conduit, wherein the first conduit and the second conduit are spaced apart and are capable of fluid communication;

a piston slidingly disposed within the central bore, wherein the piston includes a first radial protrusion and a second radial protrusion, and wherein the first radial protrusion and the second radial protrusion are spaced apart, thereby forming an inner chamber in the central bore between the first radial protrusion and the second radial protrusion;

wherein the first conduit and the second conduit converge at the inner chamber;

wherein the piston is operable such that in an opened position the first conduit and the second conduit are in fluid communication through the inner chamber;

wherein the piston is operable such that in a closed position the second radial protrusion seals the second conduit, whereby the second conduit is not in fluid communication with the inner chamber; and wherein the second conduit extends between the inner chamber and an annular bore disposed below the hanger body that surrounds the production tubing.

2. The tubing hanger assembly of claim 1, further comprising:

a first actuation chamber in the central bore disposed above the first radial protrusion;

a second actuation chamber in the central bore disposed below the second radial protrusion;

a first pressurizing conduit and a second pressurizing conduit disposed in said hanger body, wherein the first pressurizing conduit and the second pressurizing conduit are spaced apart;

wherein the first actuation chamber is in fluid communication with the first pressurizing conduit; and wherein the second actuation chamber is in fluid communication with the second pressurizing conduit.

3. The tubing hanger assembly of claim 2, wherein the first actuation chamber is filled with a pressurizing fluid operable to slide the piston into the opened position.

4. The tubing hanger assembly of claim 3, wherein the pressurizing fluid is hydraulic fluid.

5. The tubing hanger assembly of claim 2, wherein the second actuation chamber is filled with a pressurizing fluid operable to slide the piston into the closed position.

6. The tubing hanger assembly of claim 5, wherein the pressurizing fluid is hydraulic fluid.

7. The tubing hanger assembly of claim 2, further comprising means for locking the tubing hanger assembly in position within a wellbore tubular member.

8. The tubing hanger assembly of claim 1, wherein the first conduit extends between an annular space disposed above the hanger body and the inner chamber.

9. The tubing hanger assembly of claim 1, wherein the first radial protrusion is an upper shoulder, and the second radial protrusion is a lower shoulder.

10. The tubing hanger assembly of claim 1, wherein the first radial protrusion is a circumferential shoulder, and the second radial protrusion is a sleeve.

11. The tubing hanger assembly of claim 10, wherein the sleeve has an inner passage, and wherein the inner passage is defined by a first opening and a second opening.

12. A tubing hanger assembly comprising:

a single bore hanger body having a production tubing suspended therefrom;

wherein the single bore hanger body further comprises a production bore in communication with the production tubing, a first port, and a second port therein, wherein a first flow conduit extends from the first port and a second flow conduit extends from the second port;

wherein the second flow conduit extends to an annulus defined by the production tubing and a production tubing casing; and a linearly sliding piston disposed within the hanger body and the production bore and operable to open and close the second port to selectively allow fluid communication between the first flow conduit and the second flow conduit while isolating the fluid communication between the conduits from the production bore.

13. The assembly of claim 12, wherein the first flow conduit and second flow conduit converge to an inner chamber.

14. The assembly of claim 13, wherein the inner chamber is formed between a first radial protrusion and a second radial protrusion, and wherein the first radial protrusion and the second radial protrusion are disposed on an outer surface of the sliding piston.

15. The assembly of claim 14, wherein the first radial protrusion is an upper shoulder, and the second radial protrusion is a lower shoulder.

16. The assembly of claim 14, wherein the first radial protrusion is a circumferential shoulder, and the second radial protrusion is a sleeve.

17. The assembly of claim 16, wherein the sleeve has an inner passage, and wherein the inner passage is further defined by a first opening and a second opening.

18. The assembly of claim 14, wherein the second radial protrusion is operable to sealingly engage the second port.

19. A method of servicing a wellhead assembly, the method comprising:

installing a tubing hanger assembly into the wellhead assembly, the tubing hanger assembly comprising:

a hanger body further comprising a bore concentric with the wellhead assembly, a first flow conduit, and a second flow conduit, wherein the first flow conduit and second flow conduit extend longitudinally through the hanger body without crossing the bore and are spaced apart;

a linearly sliding piston disposed within the bore for selectively opening and closing the second flow conduit;

installing a christmas tree onto the wellhead assembly; and wherein the tubing hanger assembly and christmas tree are independently retrievable from the wellhead assembly.

20. The method of claim 19, further comprising closing the second flow conduit by positioning the sliding piston over the second flow conduit, and disposing a wireline plug within the bore.

21. The method of claim 20, further comprising retrieving the christmas tree separately from the tubing hanger assembly.

22. The method of claim 19, further comprising retrieving the tubing hanger assembly separately from the christmas tree.

23. A method for isolating an annular bore below a tubing hanger body, the method comprising:

disposing a piston in a central bore of the hanger body;

wherein the piston has a first radial protrusion and a second radial protrusion, thereby forming an inner chamber therebetween;

filling a first actuation chamber with a fluid, wherein the first actuation chamber is defined by the second radial protrusion and the central bore;

applying pressure to the fluid in the first actuation chamber and creating a force on the second radial protrusion, thereby displacing the piston within the central bore; and positioning the piston within the central bore such that the second radial protrusion sealingly engages a port located adjacent to the inner chamber in the central bore, wherein the port is fluidly connected with the annular bore through a conduit extending through the hanger body.

24. The method of claim 23, further comprising delivering the fluid to the actuation chamber through a pressurizing conduit.

25. The method of claim 24, wherein the fluid is hydraulic fluid.

26. The method of claim 23, wherein the annular bore is defined between a production tubing disposed below the hanger body and a production tubing casing.

27. The method of claim 23, further comprising providing a wireline plug within the central bore.

28. An integral annulus shutoff valve system comprising:

a casing at the upper end of a wellbore;

a tubing hanger body disposed within the casing, wherein the tubing hanger body comprises a central bore, a first conduit and a second conduit;

a first port disposed at a first end of the first conduit;

a second port disposed at a first end of the second conduit;

a production tubing suspended from the tubing hanger body;

an annulus bore defined between the production tubing and a production tubing casing;

a piston disposed within the central bore, wherein the piston includes first radial protrusion and a second radial protrusion, and wherein the first radial protrusion and the second radial protrusion are spaced apart, thereby forming an inner chamber in the central bore between the first radial protrusion and the second radial protrusion;

the first conduit capable of fluid communication with a region above the tubing hanger, and the second conduit capable of fluid communication with the annulus bore;

wherein the piston is operable such that in an opened position the first conduit and the second conduit are respectively in fluid communication with the inner chamber through the first port and the second port; and wherein the piston is operable such that in a closed position the second radial protrusion sealingly engages the second port and the second conduit is not in fluid communication with the inner chamber.

29. The integral annulus shutoff valve system of claim 28, further comprising:

a first actuation chamber disposed above the first radial protrusion;

a second actuation chamber disposed below the second radial protrusion;

a first pressurizing conduit and a second pressurizing conduit disposed in said hanger body, wherein the first hydraulic conduit and the second hydraulic conduit are spaced apart;

a first actuation port at a first end of the first pressurizing conduit;

a second actuation port at a first end of the second pressurizing conduit;

wherein the first actuation port is in fluid communication with the first actuation chamber; and wherein the second actuation port is in fluid communication with the second actuation chamber.

30. The integral annulus shutoff valve system of claim 29, further comprising means for locking the tubing hanger body in position within the casing.

31. The integral annulus shutoff valve system of claim 29, wherein the first actuation chamber is filled with a pressurizing fluid operable to slide the piston into the opened position.

32. The integral annulus shutoff valve system of claim 31, wherein the pressurizing fluid is hydraulic fluid.

33. The integral annulus shutoff valve system of claim 29, wherein the second actuation chamber is filled with a pressurizing fluid operable to slide the piston into the closed position.

34. The integral annulus shutoff valve system of claim 33, wherein the pressurizing fluid is hydraulic fluid.

35. The integral annulus shutoff valve system of claim 28, further comprising a christmas tree.

36. The integral annulus shutoff valve system of claim 35 further comprising a wireline plug disposed in the central bore.

37. The integral annulus shutoff valve system of claim 28, wherein the first radial protrusion is an upper shoulder, and the second radial protrusion is a lower shoulder.

38. The integral annulus shutoff valve system of claim 28, wherein the first radial protrusion is a circumferential shoulder, and the second radial protrusion is a sleeve.

39. The integral annulus shutoff valve system of claim 38, wherein the sleeve has an inner passage, and wherein the inner passage is defined by a first opening and a second opening.

* * * * *